US007837088B2

(12) United States Patent
Crutchfield

(10) Patent No.: US 7,837,088 B2
(45) Date of Patent: Nov. 23, 2010

(54) METHOD AND APPARATUS FOR MANAGING THE DELIVERY OF MAIL ITEMS

(76) Inventor: Charles Westray Crutchfield, 109 Waxwood La., Cary, NC (US) 27511-9732

( * ) Notice: Subject to any disclaimer, the term of this patent is extended or adjusted under 35 U.S.C. 154(b) by 890 days.

(21) Appl. No.: 11/168,764

(22) Filed: Jun. 29, 2005

(65) Prior Publication Data

US 2007/0000977 A1 Jan. 4, 2007

(51) Int. Cl.
*B65D 27/00* (2006.01)
*B65D 27/04* (2006.01)

(52) U.S. Cl. ..... 229/68.1; 229/71

(58) Field of Classification Search ..... 229/68.1, 229/71, 75, 300, 303
See application file for complete search history.

(56) References Cited

U.S. PATENT DOCUMENTS

| | | | | | |
|---|---|---|---|---|---|
| 652,246 | A * | 6/1900 | Chapin | 229/68.1 |
| 1,245,447 | A * | 11/1917 | Felenchak | 229/70 |
| 1,462,513 | A * | 7/1923 | Lover | 206/216 |
| 3,405,864 | A * | 10/1968 | Sloat | 229/92.9 |
| 4,444,356 | A * | 4/1984 | Hays | 229/71 |
| 4,919,325 | A * | 4/1990 | Culver | 229/71 |
| 5,399,021 | A * | 3/1995 | Litt | 383/5 |
| 5,894,986 | A * | 4/1999 | Lederman et al. | 229/71 |
| 5,967,558 | A | 10/1999 | Petkovsek | 283/61 |
| 6,109,440 | A * | 8/2000 | Cliff | 206/523 |
| 6,135,292 | A | 10/2000 | Pettner | 209/603 |
| 6,241,844 | B1 | 6/2001 | Petkovsek | 156/249 |
| 6,471,044 | B1 | 10/2002 | Isaacs et al. | 198/809 |
| 2003/0182155 | A1 | 9/2003 | Nitzan et al. | 705/1 |
| 2005/0100252 | A1 * | 5/2005 | Rivlin et al. | 383/116 |
| 2006/0089883 | A1 | 4/2006 | Peoples | |

OTHER PUBLICATIONS

Website: http://www.yourfirstpriorityпackage.com/.
Domestic Mail Manual (DMM): S918 Delivery Confirmation.
Domestic Mail Manual (DMM): S919 Signature Confirmation.
Domestic Mail Manual (DMM), Issue 58: S919 Signature Confirmation (Updated Jan. 6, 2005).
U.S. Postal Service First-Class Mail (3 pages).
UMTE States Postal Servile.

* cited by examiner

*Primary Examiner*—Jes F Pascua
(74) *Attorney, Agent, or Firm*—Ked & Associates LLP

(57) ABSTRACT

A mailer provides a new way of securing the delivery of letters, packages, parcels, and/or other items of mail through the U.S. Postal Service. The mailer includes a container and a spacer attached to an inner surface of the container. The container is designed to hold items of mail having an aggregate thickness less than a minimum thickness required to qualify as a First Class Mail parcel. The spacer has a predetermined thickness which causes the first and second sheets of the container to expand to a thickness which equals or exceeds the minimum thickness required to qualify as a First Class Mail parcel. The mailer therefore allows otherwise unqualified mail items to be sent as First Class or special services mail.

15 Claims, 5 Drawing Sheets

METHOD AND APPARATUS FOR MANAGING THE DELIVERY OF MAIL ITEMS

BACKGROUND OF THE INVENTION

1. Field of the Invention

This invention generally relates to managing the delivery of letters, packages, parcels, and/or other items of mail through the U.S. Postal Service.

2. Description of the Related Art

First Class Mail has proven to be the preferred type of mail for many postal customers. On average, it will take about three days for a First Class letter to be delivered. This is an acceptable period of time for most purposes. First Class Mail is also more private than other classes of mail. Consequently, invoices, financial statements, personal data, and confidential information is routinely delivered First Class. Post offices also give this type of mail preferential treatment, for example, by providing forwarding and return services for letters sent to wrong or moved addresses at no charge.

The U.S. Postal Service also offers customers several "special services" for mail that qualifies as First Class. These services include Delivery Confirmation and Signature Confirmation. The Delivery Confirmation service provides the sender with information about the date and time an item was delivered and, if delivery was attempted but unsuccessful, the date and time of the delivery attempt. The Signature Confirmation service provides the sender with the same information as the Delivery Confirmation service, and additionally keeps a record of each recipient's signature which is available upon request.

Some types of mail are unable to qualify as First Class or special services mail, mainly because their packaging does not meet specified size requirements. This type of mail includes but is not limited to various types of legal papers such as subpoenas and service of process, both of which would benefit greatly from the speed First Class service can provide and the assurance delivery and signature confirmation services can provide. Unfortunately, senders of this type of mail must resort to private carriers which charge significantly higher rates than any of the aforementioned services provided by the U.S. Postal service.

SUMMARY OF THE INVENTION

An objective of the present invention is to provide a new way of securing the delivery of letters, packages, parcels, and/or other items of mail through the U.S. Postal Service.

Another objective of the present invention is to secure that delivery through the use of a container which allows otherwise unqualified mail to meet the requirements of First Class and/or special service mail.

Another objective of the present invention is to provide a method which allows unqualified mail items to be delivered as First Class and/or special service mail, which method may be performed, for example, by using the aforementioned container.

These and other objects and advantages of the present invention are achieved by providing a container for holding mail that includes a spacer. In accordance with one embodiment, the container is formed from first and second flexible sheets arranged in opposing relation and coupled to one another to form an enclosure for holding one or more items of mail. This mail may have an aggregate thickness less than a minimum thickness required to qualify as a First Class Mail parcel. The spacer is attached to an inner surface of at least one of the first and second sheets, and has a predetermined thickness which causes the first and second sheets of the container to expand to a thickness which equals or exceeds the minimum thickness required to qualify as a First Class Mail parcel. The spacer may further be sized to ensure that the container satisfies requirements of one or more special postal services provided by the United States Postal Service, including but not limited to the Delivery and Signature Confirmation services.

One of the sheets forming the container may have an extension which folds over and attaches (e.g., by an adhesive strip) to the other sheet, to thereby close the container prior to delivery. The length of the extension may be limited so that closure can occur only when non-conforming or unqualified thicknesses of mail are inserted into the container. That is, if mail items having an aggregate thickness that meets or exceeds the thickness required to qualify as First Class or special services mail is placed in the container, the length of the extension will be too short to allow the adhesive strip to attach to the other sheet.

The spacer may be in the form of a block that is substantially smaller than each of the first and second sheets of the container. The block, for example, may be sized to fit into only a single corner of the container or may have a different size, provided that at least one lateral dimension of the block is substantially shorter than a corresponding dimension of the sheets of the container. By using a block as the spacer, the thickness of the container will equal or exceeds the minimum thickness required to qualify as a First Class Mail parcel only at an area where the block is located. If desired, the block may be adapted to attach to the inner surfaces of both sheets forming the container. In a second embodiment, the spacer may be loosely inserted into the container. In subsequent portions herein, the container and spacer arrangement may be referred to as a mailer.

DESCRIPTION OF THE PREFERRED EMBODIMENTS

The present invention is, in one respect, a container to be used in delivering items of mail through the U.S. Postal Service. The container may be in the form of an envelope, package, pouch, or any other structure capable of holding mail and is generically referred to herein as a mailer. The present invention is also a method for delivering items of mail which may be practiced using a mailer of this type. The items of mail are preferably smaller items such as business or legal documents, papers, and letters. However, other items may also be delivered using the mailer. These items include but are not limited to CDs, DVDs, photographs, medicine, merchandise, or a combination of the foregoing, just to name a few.

Figure 1:
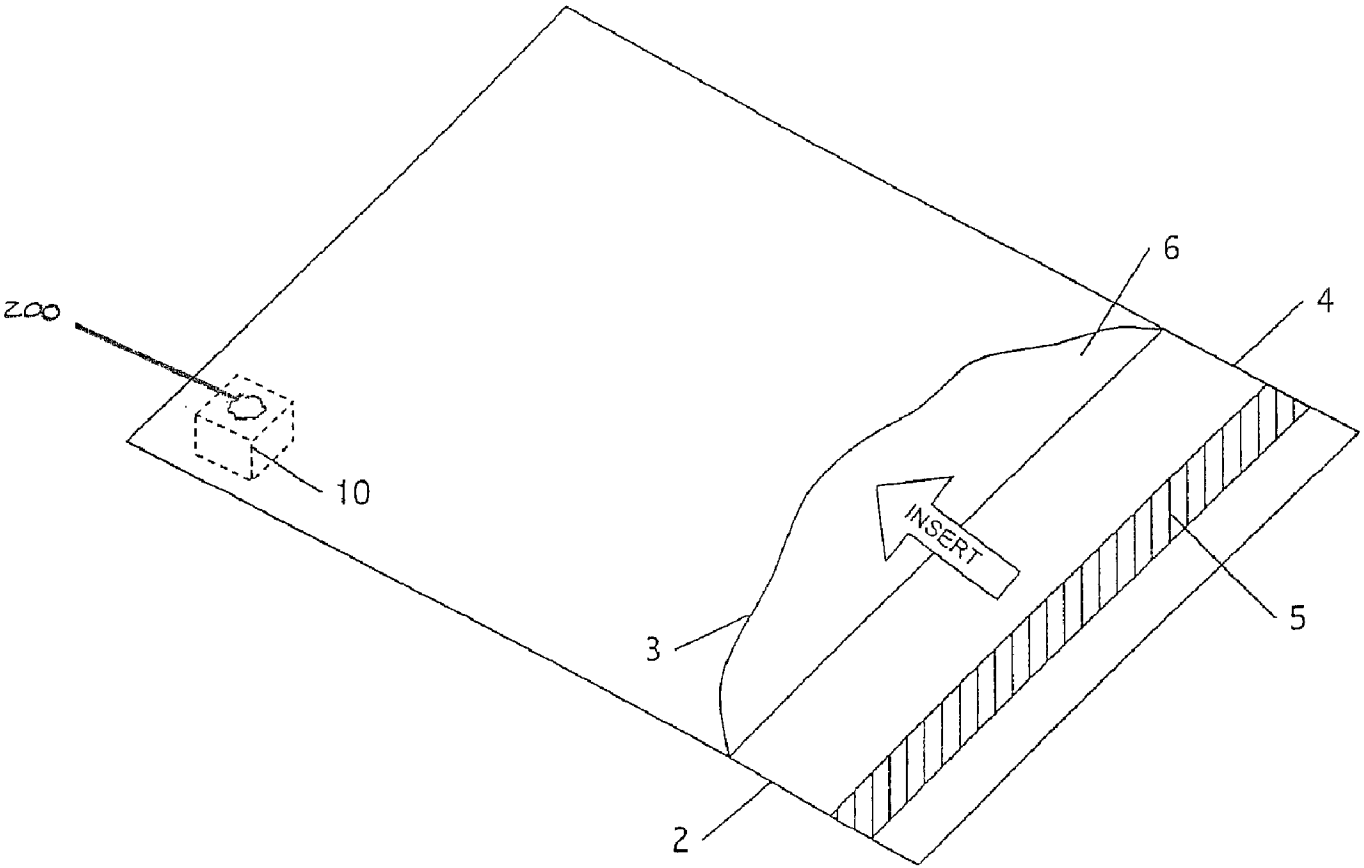
FIG. 1 is a diagram showing a mailer in accordance with one embodiment of the present invention.

FIG. 1 shows a mailer in accordance with a first embodiment of the present invention. The mailer includes a container 1 and a spacer 10. The container may be formed from first and second sheets 2 and 3 arranged in opposing relation and coupled to one another to form an enclosure. The first sheet is preferably longer in length than the second sheet in order to accommodate an extension 4 designed to fold over and attach to the second sheet to secure the items of mail in the container before mailing. The attachment may be accomplished through a peelable adhesive strip 5 located on an inner surface of the extension, or through other known techniques.

The first and second sheets are made from a flexible material such as a plastic or polymer, or even paper. The sheets may be directly connected to one another, or one or more side (e.g., accordion) pieces may be included between the sheets to allow for expansion. Irrespective of the coupling method, the sheets are arranged to form an enclosure for holding one or more items of mail, which are inserted through opening 6 prior to adhering the extension to sheet 3.

The sheets may be of any size, e.g., paper, legal, or other. In one case, the size of the container may be chosen to avoid the non-machinable surcharge currently imposed by the U.S. Postal Service. If desired, however, the size may exceed the limits for avoiding the surcharge.

During delivery, the container is preferably used to hold one or more items of mail having an aggregate thickness which is less than a minimum thickness required to qualify as a First Class Mail parcel under U.S. Postal Service guidelines. These guidelines are disclosed in the Domestic Mail Manual (DMM), which is incorporated herein by reference. Under current guidelines, the aforementioned minimum thickness is three-quarters of an inch. However, the invention is not intended to be limited to this thickness. On the contrary, the container may be designed to any desired thickness in order to accommodate, for example, changes in postal guidelines regarding thickness requirements of First Class Mail parcels, the thickness requirements of other classes of mail, and/or the thickness requirements of special services offered by the postal service.

Special services include, for example, Delivery Confirmation and Signature Confirmation services provided by the U.S. Postal Service. The Delivery Confirmation service is described in DMM, Section S918, entitled "Delivery Confirmation," the contents of which are incorporated herein by reference. The signature confirmation service is described in DMM, Section S919, entitled "Signature Confirmation," the contents of which are also incorporated herein by reference. Both services are provided by the U.S. Postal Service for items of mail that qualify as First Class Mail parcels under the postal guidelines and which also satisfy the requirements specified in Sections S918 and S919. These sections commonly require, for example, non-machinable parcels to be greater than ¾ inch at their thickest point.

In order to ensure that the mail items placed in the mailer do not exceed this thickness, the extension piece may have a length which prevents the adhesive strip from reaching sheet 3 if, for example, a document of greater that the guideline thickness is placed in the container. Making extension 4 this length is advantageous because it will allow sheets 2 and 3 to expand beyond this thickness, while simultaneously making the container unusable (e.g., unclosable) for all intents and purposes if the aggregate thickness of the mail items exceeds the minimum guideline thickness. If desired, however, extension piece 4 may be made longer so that it is able to close over and adhere to sheet 3 even when the aggregate thickness of the mail items exceed the guideline thickness.

The spacer 10 is attached to the inner surface of at least one of the first and second sheets. This may be accomplished by an adhesive 200 formed along one surface of the spacer. If the spacer is manufactured separately from the container, the surface containing the adhesive may be covered by a removable (e.g., peel-off) piece of paper. Prior to mailing, a user would then remove the paper to expose the adhesive, stick the adhesive-containing surface of the spacer on the inner surface of one of the sheets, and then insert the mail items to be delivered through the container opening.

In terms of size, the spacer has a predetermined thickness which is intentionally designed to cause the first and second sheets of the container to expand to a thickness which equals or exceeds the minimum thickness required to qualify as a First Class Mail parcel, while the extension is secured to sheet 3. The purpose of the spacer, therefore, is to allow a delivery of mail that ordinarily would not qualify as First Class Mail parcel to qualify as such a parcel. A user of the mailer of the present invention may therefore reap the benefits of First Class Mail service for the delivery of small mail items. This may prove beneficial in terms of price and speed of delivery as well as for other reasons.

In addition to the benefits of First Class Mail, the spacer may allow the first and second sheets to expand at least at one point (e.g., the location of the spacer) to a container thickness which satisfies the requirements of one or more special postal services, such as but not limited to the Delivery and/or Signature Confirmation services previously mentioned. This may prove beneficial, for example, when sending legal documents (e.g., subpoenas, service of process, etc.) or time-sensitive documents where delivery and/or signature confirmation is required or very desirable.

Figure 2A:
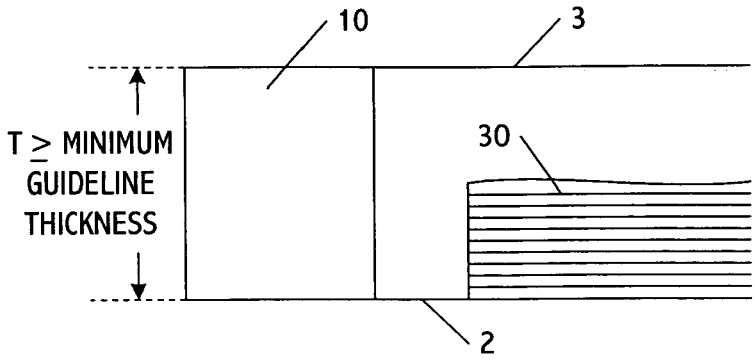
FIGS. 2*a* and 2*b* are diagrams showing different sizes of the spacer included in the mailer.

In terms of structure, the spacer may be in the shape of a block or cube having a thickness as described above and lateral dimensions which are substantially smaller than the dimensions of the first and second sheets. FIG. 2*a* shows a spacer in this shape, where the thickness, T, of the block is designed to satisfy the thickness requirements for a First Class Mail parcel. This may be satisfied in a variety of ways. For example, block 10 may have a thickness which equals or exceeds the thickness requirements, e.g., ¾-inch. In this case, the thickest point of the container will at least be equal to the block thickness.

Figure 2B:
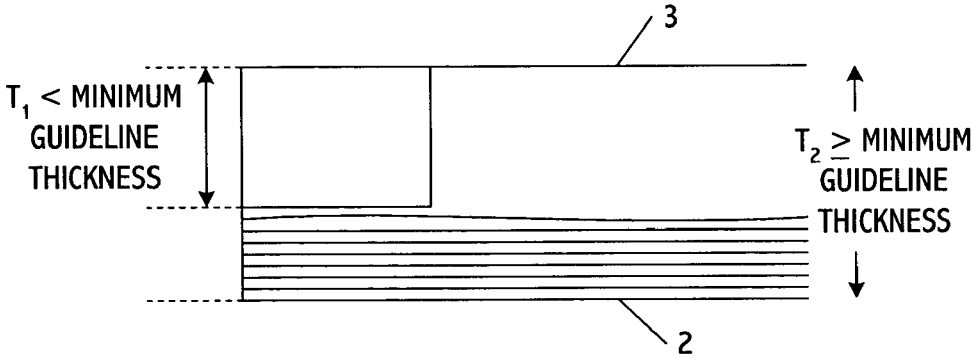

If mail items 30 in the container slide between the block and sheet 3 (which is not adhered to the block), then the thickest point of the container will equal the sum of the thickness of block 10 and the thickness of mail items 30, as shown in FIG. 2*b*. In this case, the block thickness, $T_1$, may be less than the minimum thickness required under the guidelines to qualify for a First Class Mail parcel. This type of block may be used when the user knows with reasonable certainty that the sum of $T_1$ and the mail item thickness will be a combined thickness, $T_2$, which exceeds the minimum thickness under the guidelines to qualify as a First Class Mail parcel.

In FIGS. 2*a* and 2*b*, the spacer shape is intended to create a tent-like effect where there is only one point of the container which satisfies the thickness (i.e., the point where the spacer is located) under the guidelines. All other points along the package may fall below this thickness. Nevertheless, the mailer will still qualify because the guidelines, as presently written, require only the thickest point of the mailer to meet the minimum thickness requirement.

Variations of the mailer include attaching multiple spacers between the first and second sheets, so that more than one point exists which complies with the minimum thickness requirement. Also, while a block in the form of a cube may be easy to implement, blocks of other shapes or geometries may be used including irregular shapes.

Whichever shape is used, it is preferable for the spacer to have a size that is substantially smaller than sheets 2 and 3 forming the container. For convenience purposes, the spacer size may be small enough to fit into only a single corner of the container, as shown in FIG. 1. For roughly 12.5 inch by 8.5 inch container size, such a spacer may be a 1-inch by 1-inch by 1-inch cube. In another embodiment, the cube may be a 1-inch by 1-inch by ⅝-inch cube, where the ⅝-inch dimension is the cube thickness. While the corner is a convenient place of attachment, these types of spacers may be attached to any location within the container.

Alternatively, the spacer may have one lateral dimension which is the same or substantially similar to a corresponding dimension of the container and another lateral dimension which is substantially smaller than a corresponding dimension of the container. In terms of materials, the spacer may be formed from any one of a variety of materials, including but not limited to a polymer, extruded polystyrene foam (e.g., Styrofoam®), rubber, plastic, or the like. Polymers are beneficial because they compress under pressure and then return to their original size when the pressure is removed. Styrofoam® is beneficial because it is very light in weight and therefore does not add substantially to postage costs.

As a further alternative, the spacer may have two opposing surfaces coated with an adhesive. Such a spacer may be attached to the inner surface of both sheets forming the container, to thereby provide further stability and spacer placement control.

Figure 3:
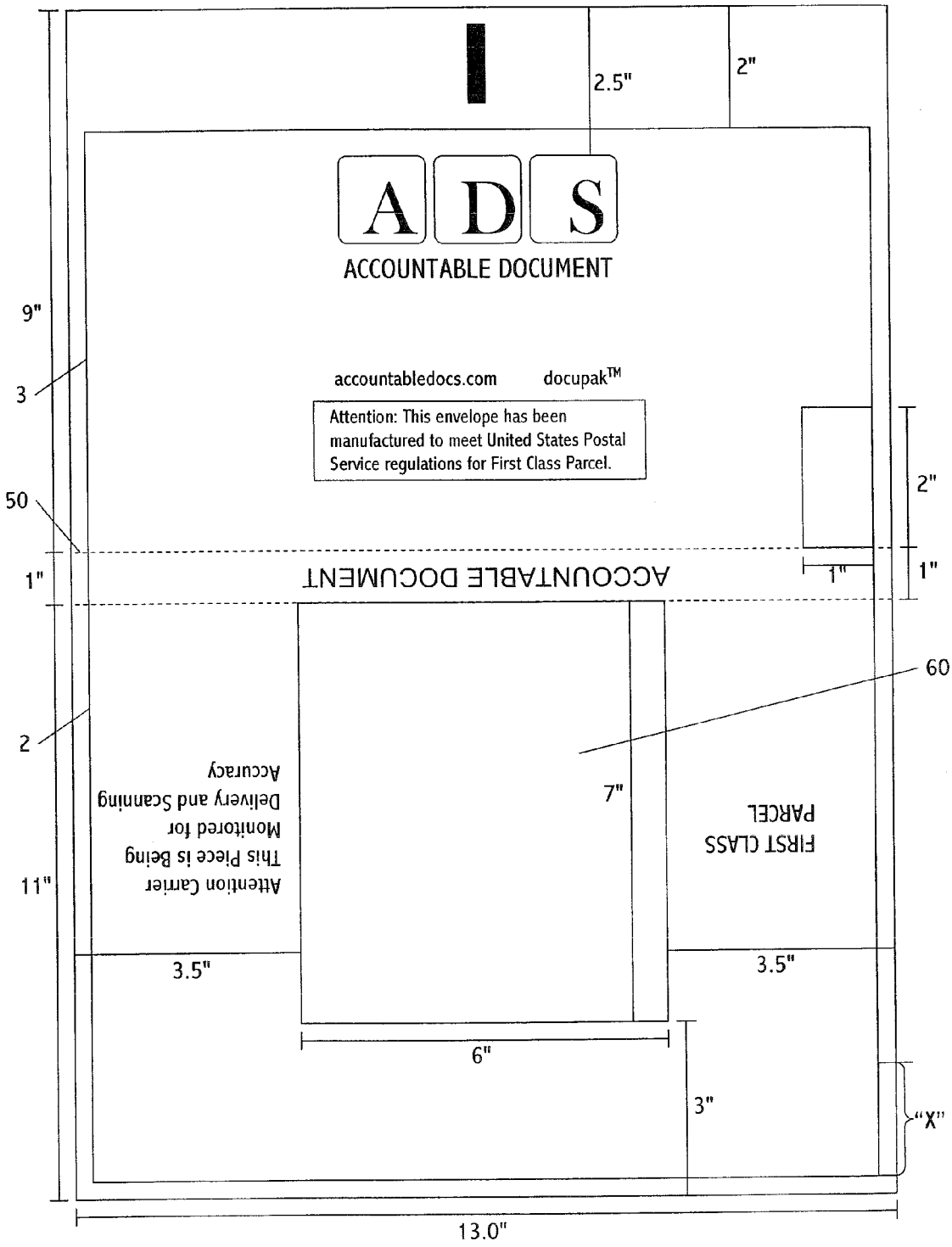
FIG. 3 is a diagram showing a view of the mailer container prior to assembly.

FIG. 3 shows a view of the mailer prior to assembly. The container of this mailer may be made from a single piece of polymer or plastic, where line 50 represents the fold line separating sheets 2 and 3. The width of the single sheet is approximately 13 inches and the length of the sheet is approximately 21 inches. With these dimensions, the fold line may be positioned so that sheet 2 is twelve inches and sheet 3 is nine inches. Sheet 2 includes a transparent window 60 for allowing portions the contents of the container to be visible. The visible portion preferably includes identifying information which may be printed on the one or more items of mail or a label included with the mail items. The identifying information may include a delivery address, a return address, postage, or special service information, or any combination thereof. Zone X marks the extension 4 which folds over and adheres to sheet 3 in order to seal the mail items within the container for delivery.

Figure 4:
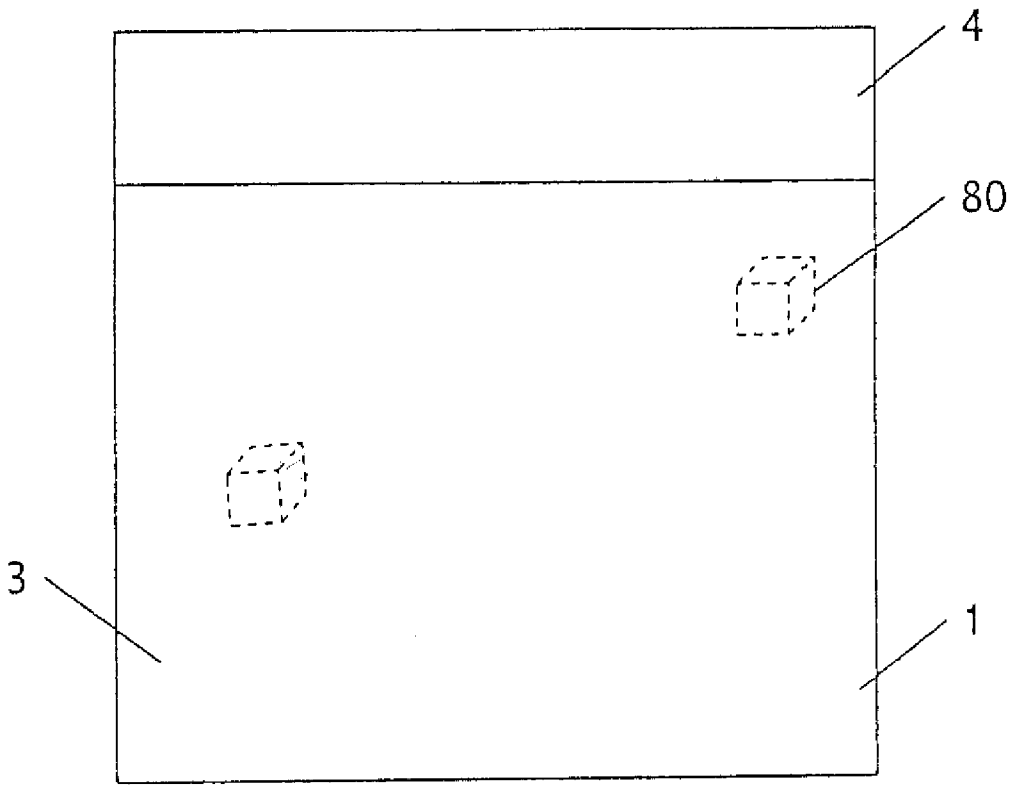
FIG. 4 is a diagram showing a mailer in accordance with another embodiment of the present invention.

FIG. 4 shows a mailer in accordance with a second embodiment of the present invention which includes a plurality of spacers 80. This mailer (shown here in a closed state) is similar to the mailer of FIG. 1 except that each spacer 80 is loosely placed within the container. Without any means of attachment, the spacers are therefore permitted to freely move within the container. In order to ensure that the mailer qualifies as a First Class Mail parcel, the spacers are preferably cubes, each with equal sides that meet or exceed the minimum the minimum thickness requirement. Thus, even when the cubes move within the container, the thickest point of the mailer will still be able to qualify for First Class Mail and/or any one of the special services previously discussed.

Figure 5:
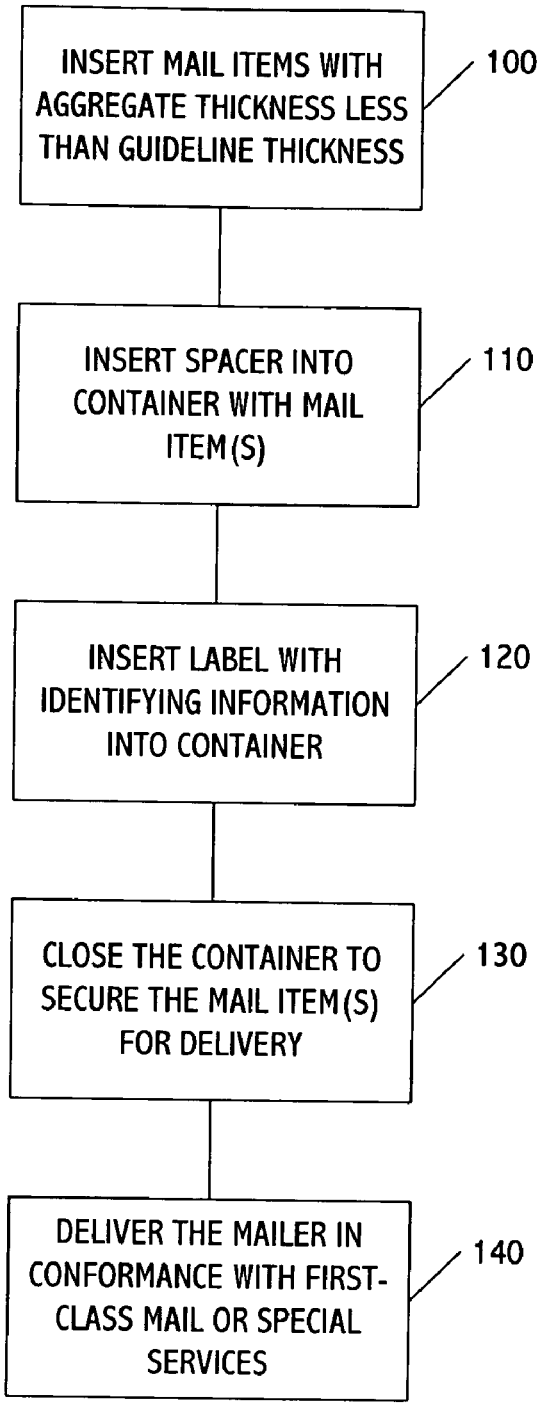
FIG. 5 is a diagram showing steps included in a method for delivering items of mail through the U.S. Postal Service, which method may be practiced using any of the embodiments of the mailer of the present invention.

FIG. 5 shows steps included in a method for delivering mail in accordance with another embodiment of the present invention. The method may be performed using any of the embodiments of the mailer previously discussed. In an initial step, a user places one or more items of mail in the container portion of the mailer. (Block 100). The mail items have an aggregate thickness which is less than a minimum thickness required to qualify as a First Class Mail parcel under U.S. Postal Service guidelines. This thickness may also be less than the requirements of one or more forms of special service mailing if desired.

In a second step, a spacer is placed inside the container. The spacer has a thickness which causes the container, at its thickest point, to equal or exceed the minimum thickness required to qualify the mailer as a First Class Mail parcel, and additionally one or more of the special services if desired. (Block 110). As previously discussed, spacer may be attached to one or both interior surfaces of the walls of the container, or the spacer merely may be loosely placed inside the container. The spacer itself may have a thickness which equals or exceeds the minimum required thickness. Or, the spacer may have a smaller thickness which, when combined with the thickness of the mail items, causes the container to exceed the minimum thickness.

In a third step, a label is placed inside the container so that identifying information on the label is visible through the window. (Block 120). The identifying information may include, for example, name and address information of the addressee, postage, and special services information.

In a fourth step, the container is closed to secure the mail items and spacer inside the mailer for delivery. (Block 130). This may be accomplished, for example, by pressing the adhesive strip on extension 4 onto the surface of sheet 3, or by other means.

Next, arrangements are made for the U.S. Postal Service to deliver the mailer to its intended destination. (Block 140). Because the thickness of the mailer meets the minimum requirements for a First Class Mail parcel and/or special services mail, the mail items (which otherwise would not qualify as such) will be delivered faster and with greater security than it would have using conventional methods of delivery.

Other modifications and variations to the invention will be apparent to those skilled in the art from the foregoing disclosure. Thus, while only certain embodiments of the invention have been specifically described herein, it will be apparent that numerous modifications may be made thereto without departing from the spirit and scope of the invention.

I claim:

1. A mailer, comprising:

a container including first and second flexible sheets arranged in opposing relation and coupled to one another to form an enclosure for holding one or more items of mail, wherein an innermost surface of at least one of the first or second sheets is in contact with the one or more items of mail and wherein outermost surfaces of the first and second sheets form exterior surfaces of the container; and a spacer including a foam block located in the container between the first and second sheets, wherein:

the one or more items of mail have an aggregate thickness less than a first thickness required to qualify as a predetermined class of mail, the foam block has a second thickness which causes the first and second sheets of the container to separate by a distance which equals or exceeds the first thickness required to qualify as said predetermined class of mail, and the foam block is located between innermost surfaces of the first and second sheets;

wherein the foam block compresses when pressure is applied and returns to an original form when the pressure is removed, the second thickness of the foam block is equal to or greater than the first thickness, each of the first and second sheets is made from only one layer of material different from and with no intervening corrugated or bubble wrap layers, the foam block includes first and second opposing surfaces, the first surface of the spacer being attached to the innermost surface of the first sheet by an adhesive and the second surface of the spacer being attached to the innermost surface of the second sheet by an adhesive, and the second thickness of the foam block is equal to or greater than the first thickness required to qualify as said predetermined class of mail.

2. The mailer of claim 1, wherein the second thickness of the foam block causes the first and second sheets to separate by a distance which satisfies a requirement of one or more special postal services provided by the United States Postal Service.

3. The mailer of claim 2, wherein the one or more special services includes a delivery confirmation service provided by the United States Postal Service.

4. The mailer of claim 2, the one or more special services includes a signature confirmation service provided by the United States Postal Service.

5. The mailer of claim 1, wherein the first sheet includes an extension for closure over an opening of the container.

6. The mailer of claim 1, wherein the foam block is substantially smaller than each of the first and second sheets of the container.

7. The mailer of claim 6, wherein the foam block is sized to fit into only a single corner of the container.

8. The mailer of claim 7, wherein the foam block is attached to said single corner.

9. The mailer of claim 1, wherein the first and second sheets are made of a polymer.

10. The mailer of claim 9, wherein the first sheet includes a transparent window for allowing identifying information on the one or more items of mail to be visible.

11. The mailer of claim 1, wherein the first and second sheets are made of paper.

12. The mailer of claim 1, wherein the first and second sheets are directly connected to one another.

13. The mailer of claim 1, wherein the first sheet includes a transparent window for making information on a label inside the container visible, said visible information including a delivery address, a return address, postage, and special service information.

14. The mailer of claim 1, wherein the first and second sheets separate to said distance which equals or exceeds the first thickness at only one location of the container, said one location corresponding to a location of the foam block between the first and second sheets.

15. The mailer of claim 1, wherein the predetermined class of mail is First Class Mail.

* * * * *